United States Patent [19]

Solymosi

[11] Patent Number: 4,903,961

[45] Date of Patent: Feb. 27, 1990

[54] ROWING MACHINE

[76] Inventor: Frank Solymosi, 255 Violet St., Massapequa Park, N.Y. 11762

[21] Appl. No.: 243,260

[22] Filed: Sep. 9, 1988

[51] Int. Cl.[4] ..... A63B 69/06

[52] U.S. Cl. ..... 272/72; 272/130; 4/497

[58] Field of Search ..... 272/71, 72, 130, 1 B, 272/93; 4/488, 491, 497, 501, 505, 498, 489, 496, 508, 513; 440/101, 105, 113

[56] References Cited

U.S. PATENT DOCUMENTS

| | | | |
|---|---|---|---|
| 927,833 | 7/1909 | Cunningham | 272/72 |
| 4,253,202 | 3/1981 | Norris | 4/497 |

FOREIGN PATENT DOCUMENTS

| | | | |
|---|---|---|---|
| 0127888 | 4/1950 | Sweden | 272/72 |
| 0597799 | 3/1978 | U.S.S.R. | 272/72 |
| 1308341 | 5/1987 | U.S.S.R. | 272/71 |
| 1362486 | 12/1987 | U.S.S.R. | 272/72 |

*Primary Examiner*—Stephen R. Crow

*Attorney, Agent, or Firm*—Collard, Roe & Galgano

[57] ABSTRACT

A rowing machine for use indoors or outdoors, consisting of a rowing attachment with a sliding seat arrangement equipped with oars, which rowing attachment is mounted between two parallel, generally oblong water-filled tanks. Flow diverters are provided in the tanks to enhance water circulation and to simulate outdoor rowing conditions. The flow diverters extend from each end of the generally oblong tanks and, at at least one end, are composed of a cover and a series of horizontally oriented plates extending from the surface of each tank to its bottom. The flow diverter includes a flow dividing wall to insure proper circulation of water therearound.

11 Claims, 3 Drawing Sheets

ROWING MACHINE

BACKGROUND OF THE INVENTION

1. Field of the Invention

This invention relates to a rowing machine which simulates the actual water resistance encountered by a rower while the entire machine remains stationary. Particularly, the invention relates to a rowing machine in which a pair of generally oblong water-filled tanks are placed on side of a rowing attachment which can be mounted between the two tanks either on the ground or on a boat within a third tank.

2. Description of the Prior Art

A so-called "rowing-tank" in which rowing club members on college rowing teams practice in the off season and in which beginners can learn the sport is often provided in indoor training facilities. This tank consists of a shallow indoor pool just large enough to accommodate a race-boat permanently anchored at one edge of the pool. The athletes train in the generally rectangular tank on one side of the boat at a time. Because of the currents generated during the rowing motion and the closed rectangular shape of the pool, water resistance in this situation is substantial. It has been found to be necessary to form the oar blades with several large holes or slots (3–4 inches in diameter) in order to reduce the water resistance and simulate the actual water resistance which would be encountered in a river or a lake.

There has been a long-felt need for a rowing machine which can more closely simulate the actual water-resistance encountered in competitive rowing conditions and which can be utilized in an indoor training facility as when the weather does not permit training under actual conditions. The rowing machine of the present invention provides three independent, shallow tanks or pools with 12–15 inches of water next to each other, with the middle tank being just large enough to accommodate a row boat having a rowing attachment thereon. Fore and aft ends of the boat are secured to the corresponding ends of the middle pool with elements such as turnbuckles or springs. The size, spacing and shape of the outer pools is determined so that the blades of the oars can make a full stroke without touching the outer side walls of these pools. Normally, the oars travel about two to three inches from the tank outer walls.

It can be seen that while the rowing attachment can be mounted in a boat in an independent tank, it can also be mounted on the ground between the two generally oblong water-filled outer tanks. Also, the rowing machine may be placed in or above a single pool with oval or oblong partitions extending downward from just above the surface to a predetermined distance below the water surface. The depth of extension of the walls of the oval partition is sufficient to produce the desired flow pattern. The oval or oblong partitions may or may not have a bottom thereto. In any case, the rowing attachment utilizes a standard sliding seat arrangement as is used on competitive sculls and in other rowing boats and machines. The shape of the outer walls of the two outer tanks when utilizing a rowing attachment having only one moving seat are oval, with the longitudinal axis of each tank parallel to the axis of the boat or rowing attachment. If two or more sliding seats are utilized, then the sides of the oblong outer tanks should be straight with round or semicircular ends.

In order to ensure proper circulation within each generally oblong outer tank, the ends thereof are provided with flow diverters having covers and a plurality of plates extending from the bottom of the pool at predetermined intervals to the cover. These flow diverters include a dividing wall and have, usually at both ends of the generally oblong tanks, a sandwich-like structure composed of generally horizontal semicircular plates. The inner diameter of the semicircle is angled with respect to the longitudinal axis of each water-filled tank such that the oars are given more room along the outer walls of the tank than on the inner walls.

When rowing starts, the water slowly begins circulating in the tanks, and the faster the circulation, the easier the oar strokes become. Full circulation can be reached in two to three minutes and after that period of time, the rowers experience the same resistance as they would experience with a boat in free water. This eliminates the necessity of making holes in the blades of the oars.

It can be seen that in the left hand oblong tank, the circulation of the water will be clockwise with respect to the rower, and in the right hand tank the circulation of the water will be counterclockwise. To ensure that there is no mixing of the flows within the generally oblong outer tanks, a divider wall or plate is placed in the middle of each tank along the longitudinal axis thereof to help keep the water circulating properly.

People who learn rowing with the present invention can participate in what is the healthiest, most entertaining, most aerobic outdoor sport. All this can be done indoors or outdoors. The tanks of the rowing machine of the present invention can be built for any length of boat and any number or rowers. A simpler and less expensive way to build the apparatus is by placing the rowing attachment having the sliding seats on the ground between the oblong outer tanks rather than in the boat in the third or middle tank.

SUMMARY OF THE INVENTION

It is an object of this invention to provide a rowing machine which can be utilized indoors or outdoors for training purposes and which simulates the natural resistance encountered by the oars during rowing and going through all phases of sliding seat rowing such as, the catch, drive, finish, release, fethering and recovery.

It is yet a further object of the invention to provide a rowing machine which includes a pair of water-filled tanks designed to make the movement of water therein as smooth as possible by inserting flow diverters or wave breaks in one or both ends of the tanks.

It is yet another object of the invention to provide a rowing machine which is simple in design and economical to fabricate and which can be used indoors, such as in rooms, halls or gymnasiums and which can be used by rowing clubs and schools or health clubs, or even by individuals in their own homes and backyards.

It is still an additional object of the invention to provide a simple and fast way for manufacturers and boat designers to test and observe the functioning of new products for rowers under controlled conditions and at close range.

It is still a further object of the invention to provide a method for exhibitions and boat shows to make demonstrations of actual rowing devices, giving interested people a chance to observe, even try out new and different boats, or parts thereof like sliding seats, oars or oarlocks, stretchers etc. set in a boat which is placed in a pool at the show.

Accordingly, these and related objects are accomplished by a rowing machine having a pair of generally oblong tanks, each having generally vertical side walls extending between first and second ends of each tank. The tanks are filled with water to a predetermined depth, normally between 12 and 15 inches. Each tank has a centrally located longitudinal axis and a centrally located transverse axis, which axes are mutually perpendicular. The generally oblong water-filled tanks are situated in side-by-side relationship, with the longitudinal axis of each tank being parallel to one another. A rowing attachment, mounted either on the ground or on a boat, is positioned between the pair of generally oblong water-filled tanks.

The rowing attachment comprises a base having a track extending along the longitudinal axis thereof, and includes at least one sliding seat which is slideable forwardly and rearwardly on the track, and includes a pair of outriggers having ends adjacent inner side walls of each tank. The outriggers extend outwardly from the longitudinally-extending track in the area of the centrally located transverse axis of each tank. At the outer end of the outriggers, there is an oarlock mounted thereon, which is positioned adjacent the inner side wall of each of the tanks. The longitudinal axis of the track is mounted parallel with the central longitudinal axis of each of the generally oblong water-filled tanks.

Each tank includes a flow diverter located in at least one of the first and second ends of each oblong tank. The flow diverter has a cover extending across the side walls and positioned above the water to prevent waves from splashing over the sides. In addition, the flow diverter includes a plurality of horizontally-oriented flow plates supported at predetermined intervals throughout the predetermined depth of the water.

The flow diverter of each of the generally oblong water-filled tanks may include a dividing wall or plate which extends between the first and second ends thereof along the central longitudinal axis. The dividing wall extends down from the surface of the water and has been found to help keep the water circulating properly. The dividing wall extends along or generally parallel to the central longitudinal axis of each tank and may include a cover along the same plane as the cover over the end portion of the flow diverter, which divider cover extends from the inner side wall of the tank to the dividing wall.

The first and second ends of each of the generally oblong tanks are formed by generally vertically extending semicircular walls connected by straight or curved side wall sections which extend generally parallel to the central longitudinal axis of the tanks. It has been found that when a single seat is used, it is preferable to have a circular or curved outer side wall in each tank which outer wall is curved at a predetermined radius centered at the oarlock located along the central transverse axis. If more than one seat is used on the rowing attachment, then the semicircular end walls may be connected by generally straight side wall sections extending parallel to the central longitudinal axis.

The radius of curvature of the outer side wall or the width of the tank as measured along the central transverse axis is determined by the length of the oars inserted in the oarlocks. The dimensions of the tanks are such that the blade of the oar is always three to four inches from the outer side wall of the tank throughout the oar stroke.

The flow diverter at least one end of each generally oblong tank includes a cover and plates which are generally semicircular in shape and are vertically aligned in parallel. The plates thereby form a plurality of horizontally-oriented flow passageways spaced a predetermined distance apart. These passageways form a sandwich-like structure which breaks the wave motion and provides for a laminar flow of the water circulating through the tank. The semicircular cover and plurality of horizontally oriented semicircular flow plates can have their inner diameter extending perpendicular to the longitudinal axis, or, preferably, angled away from the longitudinal axis. This angle is such that the distance between the diameter of the flow plates on the outer side walls is greater than in the inner side walls. This orientation permits the full movement of the oars, which is obviously further in the longitudinal direction the further one gets from the pivot point of the oarlocks.

When the rowing attachment of the rowing machine is mounted on a boat in a third tank, the boat may be attached at its fore and aft points to the longitdudinal ends of the third tank by a turnbuckle. Thus, as the rower goes through his rowing motions, the boat pulls against the aft turnbuckle which resists the forward motion of the boat.

These and other objects and advantages of the present invention will become apparent from the following description of the accompanying drawings, which disclose several embodiments of the invention. It is to be understood that the drawings are to be used for purposes of illustraton only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
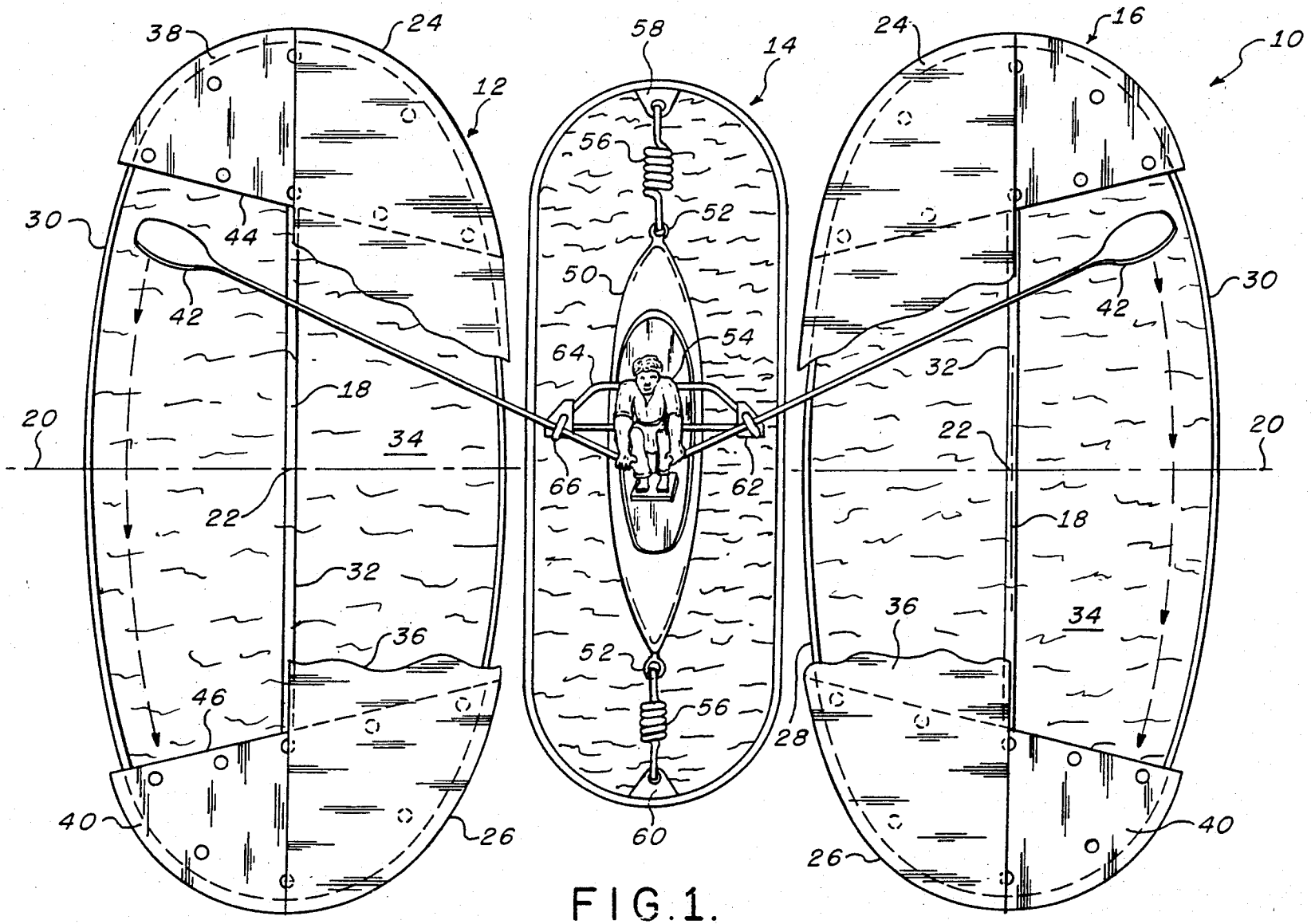
FIG. 1 is a plan view of one embodiment of the invention showing three rowing tanks.

Referring now to FIG. 1, there is shown a top or plan view of the rowing machine of the present invention, generally denoted as 10. Rowing machine 10 consists of three generally oblong tanks, 12, 14 and 16, which are filled with water and which serve to simulate a body of water such as river or lake. These tanks can be molded from thin plastic or can be made from relatively thin (1/16"–⅛") aluminum sheets. Outer tanks 12 and 16 are identical in shape and have a predetermined depth which normally contains 12–15"of water. Each tank 12 and 16 has a longitudinal axis 18 and a transverse axis 20 generally perpendicular thereto, with both axes intersecting at the center 22 of each tank. The ends 24 and 26 of each tank 12 and 16 are generally semicircular, although conceivably other shapes could be utilized. Ends 24 and 26 include covers 38 and 40 to prevent water from splashing out.

Each tank 12 and 16 has an inner side wall 28 and an outer side wall 30 connecting ends 24 and 26 of the tanks. Each tank 12 and 16 may have an underwater divider plate 32 which extends downwardly from the surface of the water to the bottom 34 of the tank, or it may, at least in part, extend slightly above the bottom, allowing some waterflow from one side of divider plate 32 along the bottom 34 to avoid scrubbing the pool liner. The portion between the divider plate 32 and inner side wall 28 of each tank may include a cover 36 which extends between covers 38 and 40 covering the ends 24 and 26 of each respective tank. Covers 36, 38 and 40 lie in the same plane and prevent the water from splashing out of tanks 12 and 16. The tanks are so made such that the cover 36 does not interfere with the movements of sufficiently wide to allow the oar, even when angled into the water, to clear the connecting point between divider plate 32 and cover 36. If necessary, divider plate 32 can be made shorter such that cover 36 is angled downwardly from side wall 28 to allow sufficient clearance for the oars of the rowing machine.

In addition, covers 38 and 40 are normally formed in a semicircular manner, but are angularly offset with respect to longitudinal axis 18 of each tank. The angular offset is such that the distance along inner side wall 28 between the ends of inner diameters 44 and 46 of covers 38 and 40 is shorter than the distance along outer side wall 30 from an adjacent end of diameter 44 or 46, respectively.

The third or middle tank 14 may also be generally oblong in shape and of the same depth as tanks 12 and 16 and can be filled with water to allow a standard rowboat or sculling boat 50 to be placed therein. Boat 50 has attachment points 52 located both fore and aft thereon (all directions with reference to the individual 54 seated therein) which connections 52 are then connected by turnbuckles or springs 56 to corresponding ends 58 and 60 of tank 14. Boat 50 is equipped with a rowing attachment generally denoted as 62 which includes outriggers 64 and oarlocks 66. Rowing attachment 62 may be either mounted in boat 50 or may be placed directly on the ground or on a surface extending between tanks 12 and 16 at a height which positions the seat thereof at a correct rowing height with respect to the water in tanks 12 and 16.

Figure 2:
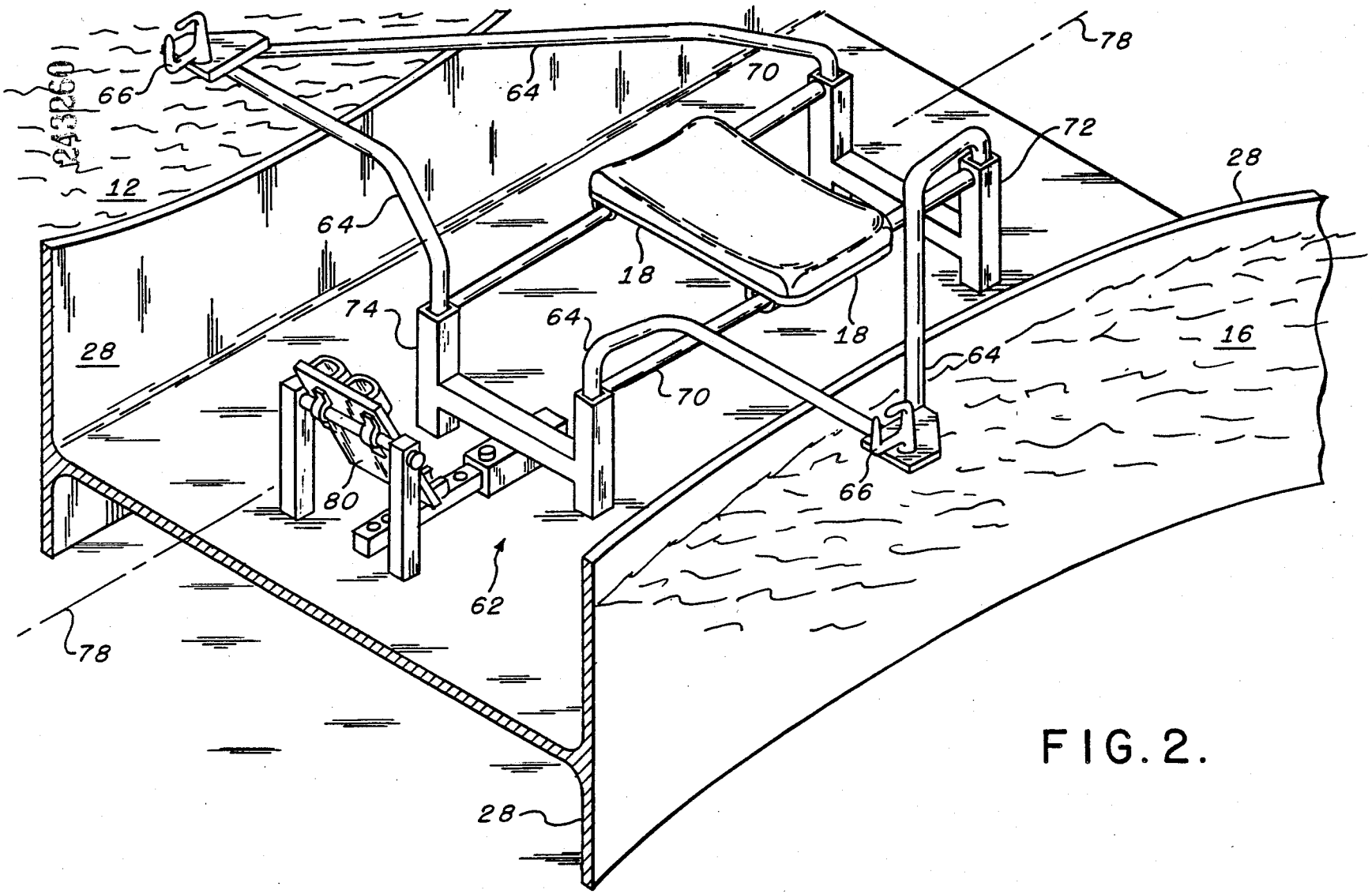
FIG. 2 is an isometric view of the rowing attachment of the present invention mounted on the ground.

Referring now to FIG. 2, the rowing attachment 62 is shown mounted on a surface extending between tanks 12 and 16 at a height appropriate for utilizing the oars in the same manner as previously described. Rowing attachment 62 has the same general configuration, either when mounted on the ground between tanks 12 and 16, or on boat 50 in tank 14. Obviously, certain dimensions may have to be changed, but the general design is identical. Rowing attachment 62 includes a seat 68 mounted on track member 70 and includes four posts 72 on either side thereof. Outrigger 64 is mounted within openings 74 within each post 72, and extends upwardly and outwardly away from track members 70. Each outrigger 64 includes an end having oarlock 66 mounted thereon adjacent side walls 28 of tanks 12 and 16. Seat 68 is slideable on track 70 forwardly and rearwardly, and is centered with respect to the longitudinal axis 78 which is parallel to and equidistant from the longitudinal axes 18 of tanks 12 and 16. A standard adjustable footrest 80 is also utilized.

Figure 3:
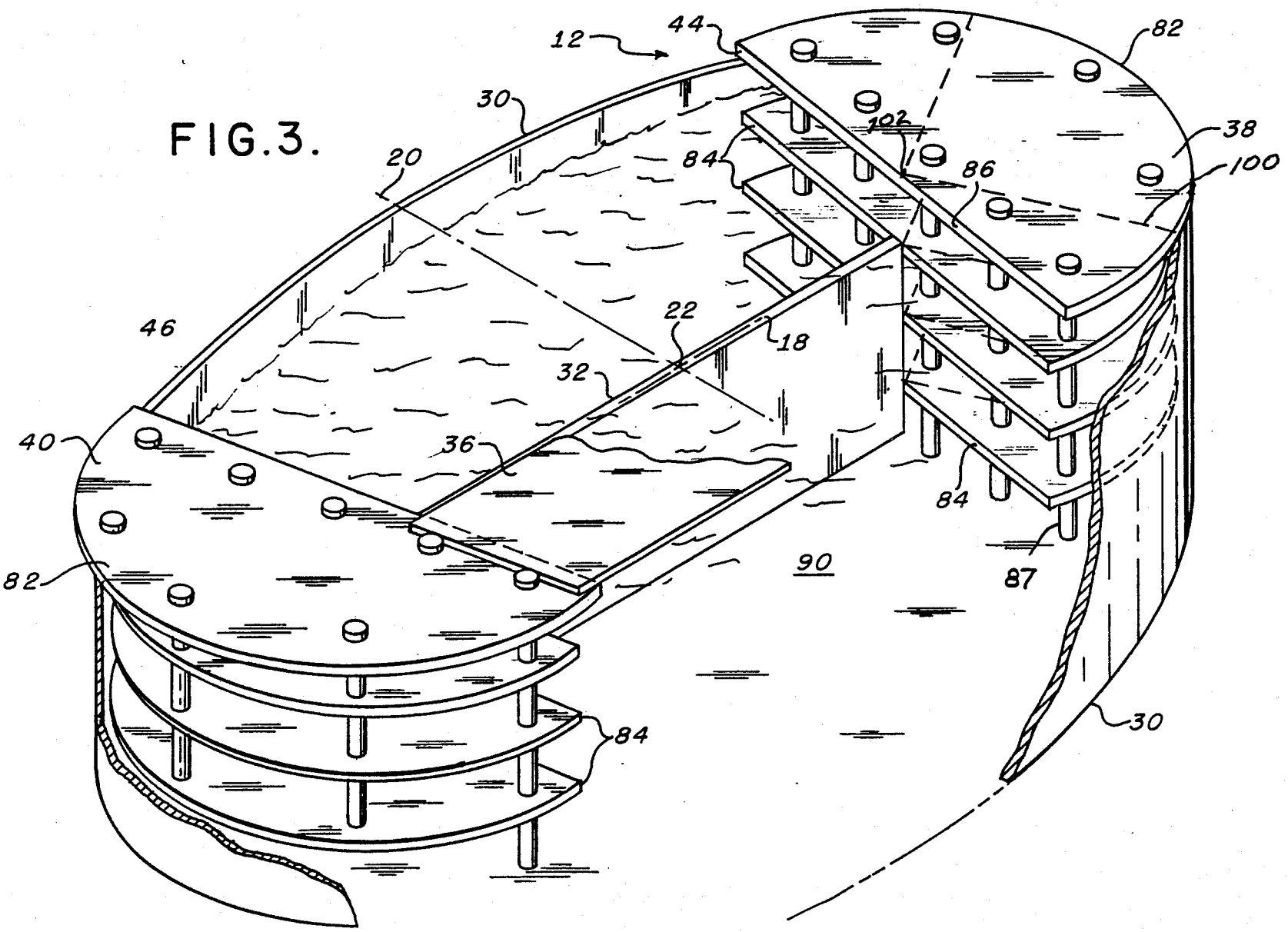
FIG. 3 is a partial isometric view of one of the outer tanks shown in FIG. 1.

Referring now to FIG. 3, there is shown an isometric view of the ends 24 and 26 of each tank 14 and 16. At least one end 24 or 26 of each tank 12 and 16 includes flow diverters 82 (both ends being shown having flow diverters 82 in FIG. 3), which reduce wave action and provide laminar flow of the water circulating through tanks 12 and 16. Flow diverters 82 are composed of a series of generally horizontal semicircular plates 84, which are spaced at a predetermined vertical distance apart, by spacers 87, starting at covers 38 and 40 down through the predetermined depth of the water to bottom 90 of the tanks. This spacing is three to four inches for tanks with a depth of 12–15 inches.

Normally, semicircular plates 84 have inner diameters 86 which are parallel to inner diameters 44 and 46 of covers 38 and 40, and are thus normally oriented at an angle with respect to the longitudinal axis 18 as described above. As water circulates around tanks 12 and 16, plates 84 tend to dampen wave action and ensure smooth flow around divider plate 32.

While covers 38 and plates 84 are shown as semicircular it has been found the flow may be kept smooth around ends 24,26 of tanks 12,16 if the cover and plates are less than semi-circular. Thus, even a 90° sector 100 (45° on each side of longitudinal axis 18 as shown in phantom in FIG. 3) produces the desired water action. The apex of the 90° sector 102 is along longitudinal axis 18 and the cover and plates 84 fan outwardly from this point.

It should be noted that while, as shown in FIG. 2, rowing attachment 62 may be mounted on the ground, it may also be mounted on a structure, preferably made of aluminum, joining tanks 12 and 16, thereby ensuring the permanent, proper location of longitudinal axis 78 with respect to longitudinal axis 18 of tanks 14 and 16 and the proper position of oarlocks 66 on transverse axis 20.

While several of the embodiments and examples of the present invention have been illustrated and described, it is obvious that many changes and modifications may be made thereunto, without departing from the spirit and scope of the invention.

What is claimed is:

1. A rowing machine comprising:

a pair of generally oblong tanks having adjacent inner side walls spaced a predetermined distance apart and each having a bottom and generally vertical side walls, which tanks are fillable with water to a predetermined height, each tank having a central longitudinal axis extending between first and second ends thereof, and a central transverse axis extending perpendicularly to said central longitudinal axis through the center of each tank, with said longitudinal axis of each of said tanks being in parallel relationship;

a rowing attachment positioned intermediate said inner side walls of said pair of generally oblong tanks, said rowing attachment comprising a base having a track extending along a longitudinal axis, at least one seat slideable forwardly and rearwardly on said track, and a pair of oarlocks mounted on said rowing attachment along said central transverse axis through the center of each tank adjacent said inner side walls of each of said generally oblong tanks, said longitudinal axis of said track being parallel to said central longitudinal axis of each of said generally oblong tanks;

a pair of oars receivable in said oarlocks; and at least one flow diverter mounted in each of said generally oblong tanks, said flow diverter including a plurality of horizontally-disposed, vertically spaced apart flow plates.

2. The rowing machine as set forth in claim 1, wherein said flow diverter has a horizontally oriented cover plate disposed adjacent one of said first and second ends of said generally oblong tanks and extending across said side walls and positioned above the predetermined height of said water.

3. The rowing machine as set forth in claim 2, wherein said cover plate and said plurality of horizontally disposed flow plates of said flow diverter are generally semicircular in shape and are vertically aligned in parallel, thereby forming a plurality of horizontally oriented flow passageways at said at least one end of each of said generally oblong tanks.

4. The rowing machine as set forth in claim 1, wherein said flow diverter of each of said generally oblong tanks includes a dividing wall extending from said tank bottom to said predetermined water height and between said first and second ends of each of said generally oblong tanks along said central longitudinal axis thereof.

5. The rowing machine as set forth in claim 4, wherein said dividing wall extending along said central longitudinal axis of each of said generally oblong tanks includes a cover extending between said inner side wall of said tank and said dividing wall, said cover extending from and contiguous with said horizontally-oriented cover plate of said flow diverter of each of said generally oblong tanks.

6. The rowing machine as set forth in claim 1, wherein said first and second ends of each of said generally oblong tanks are formed from generally vertical semicircular side walls having identical radii and connected by generally straight side wall sections extending parallel to said central longitudinal axis of each of said generally oblong tanks.

7. The rowing machine as set forth in claim 1, wherein said first and second ends of each of said generally oblong tanks are formed from generally vertical semicircular side walls and are connected by generally curved outer side walls having a predetermined radius.

8. The rowing machine as set forth in claim 7, wherein, said oars having a free end with an oar blade thereon extending into said tank and an inner end extending toward said track of said rowing attachment, said predetermined radius of said outer side wall is determined by the length of said oars such that the blade of said oar is maintained at a predetermined distance from said outer side wall throughout a rowing motion of said rowing attachment.

9. The rowing machine as set forth in claim 1, wherein said plurality of horizontally-disposed flow plates are planar and generally semicircular and have a rectilinear edge extending at a predetermined angle offset with respect to said longitudinal axis of each of said generally oblong tanks.

10. The rowing machine as set forth in claim 1, further including a third tank fillable with water to a predetermined height positioned intermediate said pair of generally oblong tanks and including a boat having said rowing attachment mounted thereon floatable in said tank when filled with water, said boat having a bow portion and an aft portion, each portion fixed to anchor points of said third tank by resilient attachment means so as to render said boat relatively stationary with respect to said pair of generally oblong tanks.

11. The rowing machine as set forth in claim 1, wherein a pair of said flow diverters is provided for each of said tanks, one of said diverters of each pair being disposed adjacent said first end of said tank and the other of said diverters being disposed adjacent said second end thereof.

* * * * *